US010719031B1

(12) United States Patent
Nishi

(10) Patent No.: US 10,719,031 B1
(45) Date of Patent: Jul. 21, 2020

(54) IMAGE FORMING APPARATUS AND CONTROL METHOD OF IMAGE FORMING APPARATUS

(71) Applicant: TOSHIBA TEC KABUSHIKI KAISHA, Tokyo (JP)

(72) Inventor: Takayuki Nishi, Fujisawa Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/566,418

(22) Filed: Sep. 10, 2019

(51) Int. Cl.
*G03G 15/08* (2006.01)

(52) U.S. Cl.
CPC ..... *G03G 15/0856* (2013.01); *G03G 15/0862* (2013.01); *G03G 2215/0888* (2013.01)

(58) Field of Classification Search
CPC ..... G03G 15/0856; G03G 15/0862; G03G 2215/0888
See application file for complete search history.

(56) References Cited

U.S. PATENT DOCUMENTS 2,381,505 A * 8/1945 Lindholm ..... B65B 57/145 222/56
5,652,947 A * 7/1997 Izumizaki ..... G03G 15/0879 399/258
5,747,824 A * 5/1998 Jung ..... A61M 1/3624 250/577
6,226,490 B1 * 5/2001 Fujita ..... G03G 21/105 399/359
7,120,366 B2 * 10/2006 Onodera ..... G03G 21/105 399/35
7,248,825 B2 * 7/2007 Nishitani ..... G03G 15/0875 399/254
7,729,624 B2 * 6/2010 Zehentbauer ..... G03G 15/0849 399/258
8,412,059 B2 * 4/2013 Nishida ..... G03G 15/553 399/27
8,626,017 B2 * 1/2014 Sakatani ..... G03G 15/0877 399/62
10,137,614 B2 * 11/2018 Fujita ..... D21B 1/021
2005/0002700 A1 * 1/2005 Nishitani ..... G03G 15/0879 399/258
2005/0117920 A1 * 6/2005 Ogata ..... G03G 15/0856 399/27

FOREIGN PATENT DOCUMENTS

JP 2014-224949 A 12/2014

* cited by examiner

*Primary Examiner* — Ryan D Walsh
(74) *Attorney, Agent, or Firm* — Kim & Stewart LLP

(57) ABSTRACT

An image forming apparatus includes a developing device, a toner tank configured to receive toner supplied from a toner cartridge mounted in the image forming apparatus and to supply the toner to the developing device, a first toner sensor configured to detect a first toner residual level in the toner tank, a second toner sensor configured to detect a second toner residual level lower than the first toner residual level in the toner tank, and a processor. The processor is configured to count a number of times the first toner sensor switches from a non-detection state to a detection state subsequent to the second toner sensor switching from a detection state to a non-detection state, and then output a notification indicating a residual amount of toner in the toner cartridge based on the counted number.

20 Claims, 4 Drawing Sheets

IMAGE FORMING APPARATUS AND CONTROL METHOD OF IMAGE FORMING APPARATUS

FIELD

Embodiments described herein relate generally to an image forming apparatus and a control method for an image forming apparatus.

BACKGROUND

An image forming apparatus performs an image forming process by receiving toner from a toner cartridge and then forming a toner image on a photosensitive drum. The image forming apparatus ultimately transfers the toner image from the photosensitive drum onto a print medium.

The image forming apparatus calculates an amount of toner supplied to the image forming apparatus from a toner cartridge (toner delivery amount), based on an amount of time toner replenishment motor is driven (the toner replenishment time) to rotate an auger or screw that delivers toner from the toner cartridge to image forming device or by evaluating image density (or number of pixels). The image forming apparatus determines when the amount of toner in the toner cartridge is low based on a sum of toner delivery amounts and the storage capacity of the toner cartridge.

However, there may be a difference between the calculated toner delivery amount(s) and the amount of toner actually supplied from the toner cartridge due to factors such as the screw rotating inertially after the toner replenishment motor stops, variations in toner flowability, toner transfer efficiency, and variations in the amount of toner actually delivered by the auger or screw. As a result, there is a problem that an output based on remaining toner levels (for example, a toner near empty indication) may not be accurate.

DETAILED DESCRIPTION

In general, according to an embodiment, an image forming apparatus includes a developing device configured to supply toner to a photosensitive drum, a toner tank configured to receive toner supplied from a toner cartridge mounted in the image forming apparatus and supply toner to the developing device, a first toner sensor configured to detect a first toner residual level in the toner tank, a second toner sensor configured to detect a second toner residual level lower than the first toner residual level in the toner tank, and a processor. The processor is configured to count a number of times the first toner sensor switches from a non-detection state to a detection state subsequent to the second toner sensor switching from a detection state to a non-detection state and to output a notification signal indicating information about a residual amount of toner in the toner cartridge based on the counted number.

Hereinafter, an image forming apparatus and a control method of the image forming apparatus according to example embodiments will be described with reference to the drawings.

Figure 1:
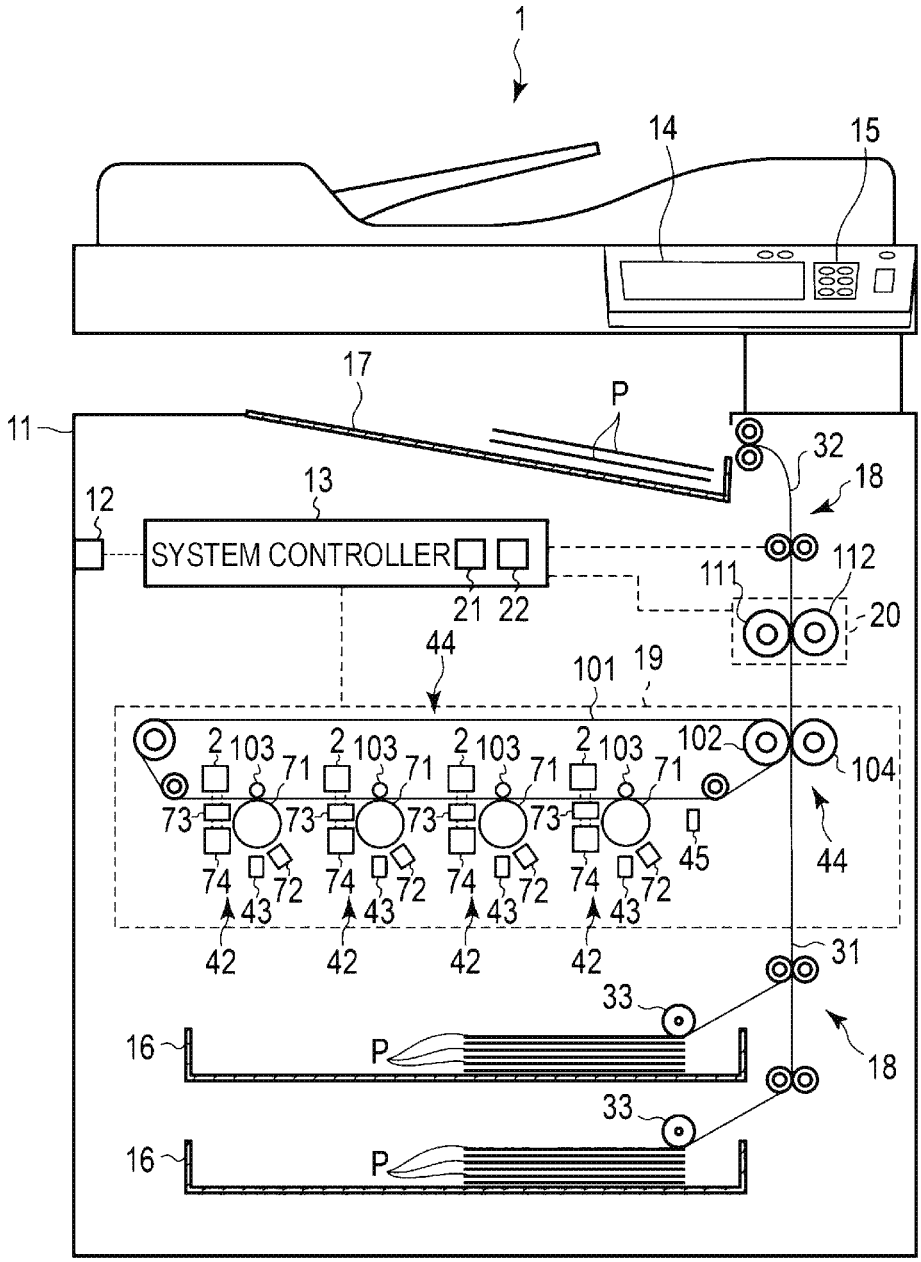
FIG. 1 is a diagram illustrating a configuration example of an image forming apparatus according to an embodiment.

FIG. 1 is a schematic diagram illustrating a configuration example of an image forming apparatus 1 according to an embodiment.

The image forming apparatus 1 is, for example, a multifunction printer (MFP) that performs various processes such as image formation while conveying a recording medium such as a sheet of paper or other print medium. The image forming apparatus 1 is, for example, a solid-state scanning printer (for example, an LED printer) that scans an LED array for image formation or aa printer with a laser scanning unit (LSU) having a mirror to direct and scan a light beam.

For example, the image forming apparatus 1 is configured to receive a toner from a toner cartridge 2 and form an image on a print medium using the received toner. The toner may be a single color toner or, for example, multiple toners of colors such as cyan, magenta, yellow, and black.

As illustrated in FIG. 1, the image forming apparatus 1 includes a casing 11, a communication interface 12, a system controller 13, a display unit 14, an operation interface 15, a plurality of paper trays 16, a paper discharge tray 17, a conveyance unit 18, an image forming unit 19, and a fixing device 20.

The casing 11 is a main body of the image forming apparatus 1. The casing 11 accommodates the communication interface 12, the system controller 13, the display unit 14, the operation interface 15, the plurality of paper trays 16, the paper discharge tray 17, the conveyance unit 18, the image forming unit 19, and the fixing device 20.

The communication interface 12 is an interface for communicating with another device. The communication interface 12 is used, for example, for communication with a host device or external device. The communication interface 12 is configured as, for example, a LAN connector. The communication interface 12 may perform wireless communication with another device in accordance with a standard such as Bluetooth® or Wi-Fi®.

The system controller 13 controls the image forming apparatus 1. The system controller 13 includes, for example, a processor 21 and a memory 22.

The processor 21 is an arithmetic unit that executes arithmetic processing. The processor 21 is, for example, a CPU. The processor 21 performs various kinds of processing based on data such as a program stored in the memory 22. The processor 21 functions as a control unit capable of executing various operations by executing a program stored in the memory 22.

The memory 22 is a storage medium storing a program and data used in the program. The memory 22 also functions as a working memory. That is, the memory 22 temporarily stores data being processed by the processor 21, a program executed by the processor 21, and the like.

The processor 21 processes various types of information by executing a program stored in the memory 22. For example, the processor 21 generates a print job based on, for example, an image acquired from an external device through the communication interface 12. The processor 21 stores the generated print job in the memory 22.

The print job includes image data indicating an image to be formed on the print medium P. The image data may be data for forming an image on one print medium P, or may be data for forming an image on a plurality of print media P.

Furthermore, the print job includes information indicating whether printing to be performed is color printing or monochrome printing.

The processor 21 functions as a controller (engine controller) that controls the operations of the conveyance unit 18, the image forming unit 19, and the fixing device 20 by executing the program stored in the memory 22. That is, the processor 21 controls conveyance of the print medium P by the conveyance unit 18, control of formation of the image on the print medium P by the image forming unit 19, fixation of the image onto the print medium P by the fixing device 20, and the like.

The image forming apparatus 1 may include an engine controller separately from the system controller 13. In this case, the engine controller performs control of conveyance of the print medium P by the conveyance unit 18, control of formation of an image on the print medium P by the image forming unit 19, and control of fixation of the image onto the print medium P by the fixing device 20, and the like. In this case, the system controller 13 supplies the engine controller with information necessary for control in the engine controller.

The display unit 14 includes a display that displays a screen according to a video signal input from a display controller such as the system controller 13 or a graphic controller (not separately illustrated). For example, screens for various settings of the image forming apparatus 1 are displayed on the display of the display unit 14.

The operation interface 15 is connected to an input device (not separately illustrated). The operation interface 15 supplies an operation signal to the system controller 13 according to an operation of the input device. The input device is, for example, a touch sensor, a numeric keypad, a power button, a paper feed button, various function keys, or a keyboard. The touch sensor acquires information indicating a designated position in a certain area. The touch sensor is configured as a touch panel integrally with the display unit 14, and inputs a signal indicating a touched position on the screen displayed on the display unit 14 to the system controller 13.

Each of the paper trays 16 is a cassette for storing the print medium P. The paper tray 16 is configured to be able to supply the print medium P from the outside of the casing 11. For example, the paper tray 16 is configured to be able to be pulled out of the casing 11.

The paper discharge tray 17 is a tray that supports the print medium P discharged from the image forming apparatus 1.

Next, a configuration for conveying the print medium P of the image forming apparatus 1 will be described.

The conveyance unit 18 is a mechanism for conveying the print medium P in the image forming apparatus 1. As illustrated in FIG. 1, the conveyance unit 18 includes a plurality of conveyance paths. For example, the conveyance unit 18 includes a paper feed conveyance path 31 and a paper discharge conveyance path 32.

The paper feed conveyance path 31 and the paper discharge conveyance path 32 are each comprise a plurality of motors, rollers, and guides, which are not separately illustrated. The plurality of motors rotates a shaft based on control of the system controller 13 to rotate a roller interlocked with the rotation of the shaft. The rollers move the print medium P by rotating. The guides control a conveyance direction of the print medium P.

The paper feed conveyance path 31 takes in the print medium P from the paper tray 16 and supplies the taken-in print medium P to the image forming unit 19. The paper feed conveyance path 31 includes pickup rollers 33 corresponding to the respective paper trays. Each pickup roller 33 takes in the print medium P of the paper tray 16 into the paper feed conveyance path 31.

The paper discharge conveyance path 32 is a conveyance path for discharging the print medium P on which an image is formed from the casing 11. The print medium P discharged by the discharge conveyance path 32 is supported by the paper discharge tray 17.

Next, the image forming unit 19 will be described.

The image forming unit 19 is configured to form an image on the print medium P. Specifically, the image forming unit 19 forms an image on the print medium P based on a print job generated by the processor 21.

The image forming unit 19 includes a plurality of loading units 41, a plurality of process units 42, a plurality of exposure devices 43, a transfer mechanism 44, and a density sensor 45. The image forming unit 19 includes the loading unit 41 and the exposure device 43 for each process unit 42. Since the plurality of process units 42, the plurality of loading units 41, and the plurality of exposure devices 43 have the same configuration, one process unit 42, one loading unit 41, and one exposure device 43 will be described FIG. 2 is a schematic diagram illustrating an example of the configuration of a part of the image forming unit 19.

First, the loading unit 41 to which the toner cartridge 2 is loaded will be described.

Figure 2:
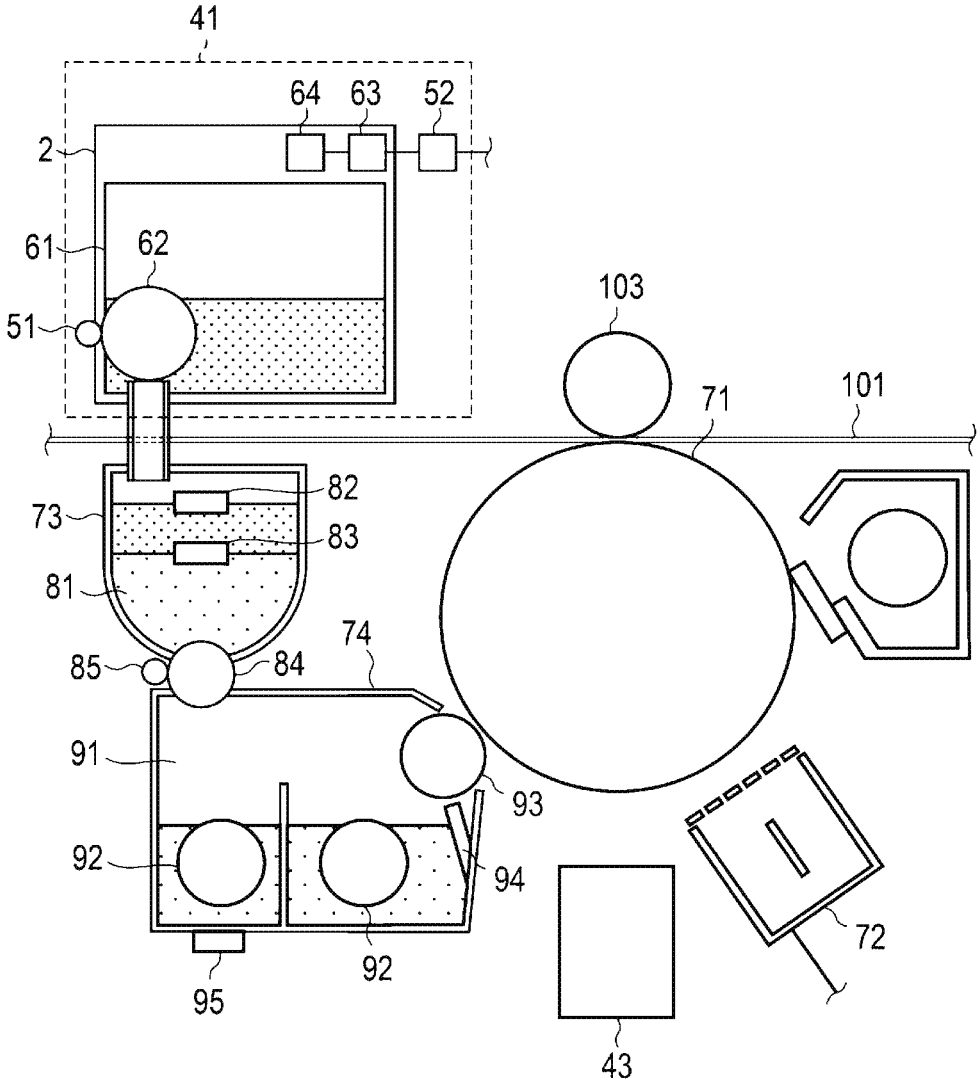
FIG. 2 is a diagram illustrating a configuration example of a part of an image forming unit.

As illustrated in FIG. 2, the loading unit 41 is a module to which the toner cartridge 2 filled with the toner is mounted. The plurality of loading units 41 each include a space in which the toner cartridge 2 is loaded, a first toner replenishment motor 51, and a toner cartridge communication interface 52.

The first toner replenishment motor 51 drives a toner delivery mechanism of the toner cartridge 2 described below based on the control of the processor 21, and may be referred to as a toner supply motor. The first toner replenishment motor 51 is connected to the toner delivery mechanism of the toner cartridge 2 when the toner cartridge 2 is loaded in the loading unit 41.

The toner cartridge communication interface 52 communicates with the toner cartridge 2. The toner cartridge communication interface 52 is connected to the communication interface of the toner cartridge 2 when the toner cartridge 2 is loaded in the loading unit 41.

Next, the toner cartridge 2 will be described.

As illustrated in FIG. 2, the toner cartridge 2 includes a toner storage container 61, a toner delivery mechanism 62, a communication interface 63, and an IC chip 64.

The toner storage container 61 is a container for storing the toner.

The toner delivery mechanism 62 delivers the toner in the toner storage container 61. The toner delivery mechanism 62 is, for example, a screw provided in the toner storage container 61 and delivering the toner by rotating. The toner delivery mechanism 62 is driven by the first toner replenishment motor 51. The toner cartridge 2 may be configured to include a motor for rotating the toner delivery mechanism 62.

The communication interface 63 is an interface for communicating with the image forming apparatus 1. The communication interface 63 is connected to the toner cartridge communication interface 52 when the toner cartridge 2 is attached to the loading unit 41.

The IC chip 64 includes a memory in which various control data are stored in advance, and a processor. The control data is, for example, an "identification code" and a "near empty threshold value". The "identification code" indicates a type and/or model number of the toner cartridge 2 and the like. The "near empty threshold value" is a threshold value used by the image forming apparatus 1 to determine whether the amount of toner remaining in the toner cartridge 2 is small.

Next, the process unit 42 will be described.

The process unit 42 is configured to form a toner image. For example, a plurality of process units 42 is provided for each type of toner. For example, the plurality of process units 42 corresponds to color toners such as cyan, magenta, yellow, and black, respectively. Specifically, each process unit 42 is connected with the toner cartridge 2 having toners of different colors.

As illustrated in FIG. 2, the process unit 42 includes a photosensitive drum 71, an electrifying charger 72, a sub-tank 73, and a developing device 74.

The photosensitive drum 71 is provided with a cylindrical drum and a photosensitive layer formed on the outer peripheral surface of the drum. The photosensitive drum 71 is rotated at a constant speed by a drive mechanism (not separately illustrated).

The electrifying charger 72 uniformly charges the surface of the photosensitive drum 71. For example, the electrifying charger 72 applies a voltage (referred to as a developing bias voltage) to the photosensitive drum 71 using a charging roller to charge the photosensitive drum 71 to a uniform negative potential (referred to as a contrast potential). The charging roller is rotated by rotation of the photosensitive drum 71 in a state where a predetermined pressure is applied to the photosensitive drum 71.

The sub-tank 73 receives the toner from the toner cartridge 2 and stores the received toner. The sub-tank 73 supplies the toner to the developing device 74. The sub-tank 73 includes a toner storage container 81, a first toner residual amount sensor 82, a second toner residual amount sensor 83, a toner delivery mechanism 84, and a second toner replenishment motor 85.

The toner storage container 81 is a container for storing the toner received from the toner cartridge 2.

The first toner residual amount sensor 82 and the second toner residual amount sensor 83 are sensors for detecting the residual amount of toner in the toner storage container 81. The first toner residual amount sensor 82 and the second toner residual amount sensor 83 are provided in the toner storage container 81. Each of the first toner residual amount sensor 82 and the second toner residual amount sensor 83 is a sensor that detects presence or absence of toner to determine whether or not the toner is present at the position (e.g., level) where each sensor is provided. The first toner residual amount sensor 82 and the second toner residual amount sensor 83 are configured by, for example, a piezoelectric sensor, a transmitted light sensor, a reflected light sensor, or the like.

The first toner residual amount sensor 82 and the second toner residual amount sensor 83 output an ON signal when the toner is present at their respective detection positions. Output signals of the first toner residual amount sensor 82 and the second toner residual amount sensor 83 are turned off when the toner is not present at their respective detection positions.

The first toner residual amount sensor 82 detects the presence or absence of toner at a position higher in the vertical direction than the second toner residual amount sensor 83 in the toner storage container 81. When the first toner residual amount sensor 82 is just turned from OFF to ON, the residual amount of toner in the toner storage container 81 is referred to as a first toner residual amount. That is, the first toner residual amount can be considered as the threshold value at which the first toner residual amount sensor 82 is turned from OFF to ON.

The second toner residual amount sensor 83 detects the presence or absence of toner at a position (below in the vertical direction the first toner residual amount sensor 82 in the toner storage container 81. When the second toner residual amount sensor 83 is just turned from OFF to ON, the residual amount of the toner in the toner storage container 81 is referred to as a second toner residual amount. That is, the second toner residual amount can be considered as the threshold value at which the second toner residual amount sensor 83 is turned from OFF to ON.

The toner delivery mechanism 84 delivers the toner in the toner container 81 to the developing device 74. The toner delivery mechanism 84 is, for example, a screw provided in the toner storage container 81 and delivering the toner by rotating. The toner delivery mechanism 84 is driven by the second toner replenishment motor 85.

The second toner replenishment motor 85 drives the toner delivery mechanism 84 based on control of the processor 21, and may be referred to as a toner supply motor. The second toner replenishment motor 85 supplies the toner in the toner storage container 81 to the developing device 74 by driving the toner delivery mechanism 84.

The developing device 74 is a device that causes the toner to be developed onto the photosensitive drum 71. The developing device 74 includes a developer container 91, a stirring mechanism 92, a developing roller 93, a doctor blade 94, an automatic toner control (ATC) sensor 95, and the like.

The developer container 91 is a container for containing developer containing toner and carrier. The developer container 91 receives the toner delivered from inside the toner storage container 81 of the sub-tank 73 by the toner delivery mechanism 84 of the sub-tank 73. The carrier is stored in the developer container 91 when the developing device 74 is manufactured.

The stirring mechanism 92 is driven by a motor (not separately illustrated) to stir the toner and the carrier in the developer container 91.

The developing roller 93 causes the developer to be developed onto the surface thereof by rotating in the developer container 91.

The doctor blade 94 is a member disposed at a predetermined distance from the surface of the developing roller 93. The doctor blade 94 removes a part of developer developed onto the surface of the rotating developing roller 93. With this configuration, a layer of developer having a thickness corresponding to the distance between the doctor blade 94 and the surface of the developing roller 93 is formed on the surface of the developing roller 93.

The ATC sensor 95 is, for example, a magnetic flux sensor including a coil and detecting a voltage value generated in the coil. A detection voltage of the ATC sensor 95 changes in accordance with density of the magnetic flux from the toner in the developer container 91. That is, the system controller 13 can determine a concentration ratio of the toner remaining in the developer container 91 to the carrier based on the detection voltage of the ATC sensor 95.

Next, the exposure device 43 will be described.

The exposure device 43 includes a plurality of light emitting elements. The exposure device 43 forms a latent image on the photosensitive drum 71 by irradiating the charged photosensitive drum 71 with light from the light emitting element. The light emitting element is, for example, a light emitting diode (LED) or the like. One light emitting element is configured to emit light to one point on the photosensitive drum 71. The plurality of light emitting elements is arranged in the main scanning direction which is a direction parallel to the rotation axis of the photosensitive drum 71.

The exposure device 43 forms a latent image of one line on the photosensitive drum 71 by irradiating the photosensitive drum 71 with light by a plurality of light emitting elements arranged in the main scanning direction. Furthermore, the exposure device 43 forms a latent image of a plurality of lines by continuously irradiating the rotating photosensitive drum 71 with light.

In the configuration described above, when the surface of the photosensitive drum 71 charged by the electrifying charger 72 is irradiated with light from the exposure device 43, an electrostatic latent image is formed. When the developer layer formed on the surface of the developing roller 93 approaches the surface of the photosensitive drum 71, the toner contained in the developer is transferred to the latent image formed on the surface of the photosensitive drum 71. With this configuration, a toner image is formed on the surface of the photosensitive drum 71.

Next, the transfer mechanism 44 will be described.

The transfer mechanism 44 is configured to transfer the toner image formed on the surface of the photosensitive drum 71 to the print medium P.

As illustrated in FIGS. 1 and 2, the transfer mechanism 44 includes, for example, a primary transfer belt 101, a secondary transfer counter roller 102, a plurality of primary transfer rollers 103, and a secondary transfer roller 104.

The primary transfer belt 101 is an endless belt wound around a secondary transfer counter roller 102 and a plurality of winding rollers. An inner surface (inner peripheral surface) of the next transfer belt 101 contacts the secondary transfer opposite roller 102 and the plurality of winding rollers, and an outer surface (outer peripheral surface) faces the photosensitive drum 71 of the process unit 42.

The secondary transfer counter roller 102 is rotated by a motor (not separately illustrated). The secondary transfer counter roller 102 conveys the primary transfer belt 101 in a predetermined conveyance direction by rotating. The plurality of winding rollers is configured to be freely rotatable. The plurality of winding rollers rotate according to the movement of the primary transfer belt 101 by the secondary transfer counter roller 102.

The plurality of primary transfer rollers 103 are configured to bring the primary transfer belt 101 into contact with the photosensitive drum 71 of the process unit 42. The plurality of primary transfer rollers 103 correspond to the photosensitive drums 71 of the plurality of process units 42, respectively. Specifically, the plurality of primary transfer rollers 103 are provided at positions facing the photosensitive drums 71 of the corresponding process units 42 with the primary transfer belt 101 interposed therebetween. The primary transfer roller 103 contacts the inner peripheral surface side of the primary transfer belt 101 and displaces the primary transfer belt 101 to the photosensitive drum 71 side. With this configuration, the primary transfer roller 103 brings the outer peripheral surface of the primary transfer belt 101 into contact with the photosensitive drum 71.

The secondary transfer roller 104 is provided at a position facing the primary transfer belt 101. The secondary transfer roller 104 contacts the outer peripheral surface of the primary transfer belt 101 and applies pressure thereto. With this configuration, a transfer nip is formed in which the secondary transfer roller 104 and the outer peripheral surface of the primary transfer belt 101 are in close contact. When the print medium P passes through the transfer nip, the secondary transfer roller 104 presses the print medium P passing through the transfer nip against the outer peripheral surface of the primary transfer belt 101.

The secondary transfer roller 104 and the secondary transfer counter roller 102 rotate and convey the print medium P supplied from the paper feed conveyance path 31 in a state where the print medium P is sandwiched therebetween. With this configuration, the print medium P passes through the transfer nip.

In the configuration described above, when the outer peripheral surface of the primary transfer belt 101 contacts the photosensitive drum 71, the toner image formed on the surface of the photosensitive drum is transferred to the outer peripheral surface of the primary transfer belt 101. As illustrated in FIG. 1, when the image forming unit 19 includes the plurality of process units 42, the primary transfer belt 101 receives a toner image from the photosensitive drums 71 of the plurality of process units 42. The toner image transferred to the outer peripheral surface of the primary transfer belt 101 is conveyed by the primary transfer belt 101 to the transfer nip where the secondary transfer roller 104 and the outer peripheral surface of the primary transfer belt 101 are in close contact. When the print medium P exists in the transfer nip, the toner image transferred to the outer peripheral surface of the primary transfer belt 101 is transferred to the print medium P in the transfer nip.

Next, the density sensor 45 will be described.

The density sensor 45 detects density of the toner image transferred to the outer peripheral surface of the primary transfer belt 101. The density sensor 45 includes illumination for irradiating the primary transfer belt 101 with light, an image sensor for converting light into an electric signal, and an optical system for focusing light from the outer peripheral surface of the primary transfer belt 101 on the image sensor. The density sensor 45 may be configured by a plurality of sensors that detect toner images at a plurality of different positions in the main scanning direction.

The density sensor 45 detects reflected light reflected from the detection position on the outer peripheral surface of the primary transfer belt 101 by the image sensor. With this configuration, the density sensor 45 detects a test pattern formed by the toner image on the outer peripheral surface of the primary transfer belt 101, and acquires a detection voltage.

The detection voltage of the density sensor 45 changes with the density of the toner image on the outer peripheral surface of the primary transfer belt 101. That is, the system controller 13 can determine whether the density of the toner image on the outer peripheral surface of the primary transfer belt 101 is lower or higher than target density, based on the detection voltage of the density sensor 45.

The detection timing of the detection voltage of the density sensor 45 changes depending on a position at which the photosensitive drum 71 and the primary transfer belt 101 are in contact, a position which is irradiated with light by the exposure device 43 on the photosensitive drum 71, and the like. That is, the system controller 13 can determine relative positional deviation, skew, and the like among the plurality of process units 42, based on the detection timing of the detection voltage of the concentration sensor 45.

Next, a configuration regarding fixing of the image forming apparatus 1 will be described.

The fixing device 20 fixes the toner image on the print medium P onto which the toner image is transferred. The fixing device 20 operates based on control of the system controller 13. The fixing device 20 includes a heating member that applies heat to the print medium P and a pressure member that applies pressure to the print medium P. For example, the heating member is a heat roller 111. Also, for example, the pressing member is a press roller 112.

The heat roller 111 is a fixing rotating body which is rotated by a motor (not separately illustrated). The heat roller 111 has a hollow core made of metal and an elastic layer formed on the outer periphery of the core. The heat roller 111 is heated to a high temperature by a heater disposed inside the hollow core. The heater is, for example, a halogen heater. The heater may be an induction heating (IH) heater that heats the core by electromagnetic induction.

The press roller 112 is provided at a position facing the heat roller 111. The press roller 112 has a core made of metal with a predetermined outer diameter, and an elastic layer formed on the outer periphery of the core. The press roller 112 applies pressure to the heat roller 111 by force applied from a tension member (not separately illustrated). By applying pressure from the press roller 112 to the heat roller 111, a nip (referred to as a fixing nip) in which the press roller 112 and the heat roller 111 are in close contact with each other is formed. The press roller 112 is rotated by a motor (not separately illustrated). The press roller 112 rotates to move the print medium. P entering the fixing nip and presses the print medium P against the heat roller 111.

With the configuration described above, the heat roller 111 and the press roller 112 apply heat and pressure to the print medium P passing through the fixing nip. As a result, the toner image is fixed on the print medium P which has passed through the fixing nip. The print medium P that has passed through the fixing nip is introduced into the sheet discharge conveyance path 32 and is discharged to the outside of the casing 11.

Next, control of the image forming apparatus 1 by the system controller 13 will be described.

The processor 21 of the system controller 13 controls a development bias voltage when charging the photosensitive drum 71 by the charger 72 or an exposure power when forming a latent image on the photosensitive drum 71 by the exposure device 43 and the like, based on the detection voltage of the density sensor 45. With this configuration, the processor 21 controls density of the toner image on the outer peripheral surface of the primary transfer belt 101 to be target density.

The processor 21 controls the timing of irradiating the photosensitive drum 71 with light from the exposure device 43 based on the detection timing of the detection voltage of the density sensor 45. With this configuration, the processor 21 corrects relative positional deviation and skew among the plurality of process units 42.

The processor 21 controls an operation of the second toner replenishment motor 85 based on the detection voltage of the ATC sensor 95. For example, when the detection voltage of the ATC sensor 95 is less than a preset threshold value, the processor 21 determines that the toner concentration ratio in the developer container 91 of the developing device 74 decreases. Therefore, when the detection voltage of the ATC sensor 95 is less than the preset threshold value, the processor operates the second toner replenishment motor 85 to replenish the toner from the toner storage container 81 of the sub-tank 73 to the developer container 91 of the developing device 74. With this configuration, the processor 21 controls the operation of the second toner replenishment motor 85 such that the toner concentration ratio in the developer container 91 of the developing device 74 falls within a predetermined range.

The processor 21 controls the operation of the first toner replenishment motor 51 based on the detection result of the first toner residual amount sensor 82 and the detection result of the second toner residual amount sensor 83. For example, when the detection result of the second toner residual amount sensor 83 is switched from ON to OFF, the processor 21 operates the first toner replenishment supply motor 51 until the detection result of the first toner residual amount sensor 82 is switched from OFF to ON. With this configuration, the processor 21 replenishes toner from the toner storage container 61 of the toner cartridge 2 to the toner storage container 81 of the sub-tank 73. That is, the processor 21 controls the toner residual amount in the toner storage container 81 of the sub-tank 73 to be an amount between the second toner residual amount at which the second toner residual amount sensor 83 is turned from ON to OFF and the first toner residual amount at which the first toner residual amount sensor 82 is turned from OFF to ON.

Furthermore, the processor 21 determines whether or not the residual amount of toner in the toner storage container 61 of the toner cartridge 2 is in a low state (near empty state), based on the number of times the first toner residual amount sensor 82 and the second toner residual amount sensor 83 are switched ON and OFF.

First, the processor 21 acquires a near empty threshold value from the IC chip 64 of the toner cartridge 2 through the toner cartridge communication interface 52. Next, the processor 21 determines whether or not it is in the near empty state, based on the number of times the first toner residual amount sensor 82 is turned from OFF to ON by operating the first toner replenishment motor 51 with the second toner residual amount sensor 83 turned OFF from the ON state and the near empty threshold value.

The processor 21 may be configured to determine whether or not the residual amount of toner in the toner storage container 61 of the toner cartridge 2 is in the near empty state based on the number of times the second toner residual amount sensor 83 is turned from ON to OFF and the near empty threshold value.

When the processor 21 has determined that the residual amount of toner in the toner storage container 61 of the toner cartridge 2 is in the near empty state, the processor 21 outputs a notification regarding the residual amount of toner from the display unit 14 or the communication interface 12. For example, the processor 21 causes the display unit 14 to output a toner near empty indication or signal (toner near empty display) indicating that the residual amount of toner in the toner cartridge 2 is low.

Next, a process relating to the toner near empty display in the image forming apparatus 1 will be described further.

Figure 3:
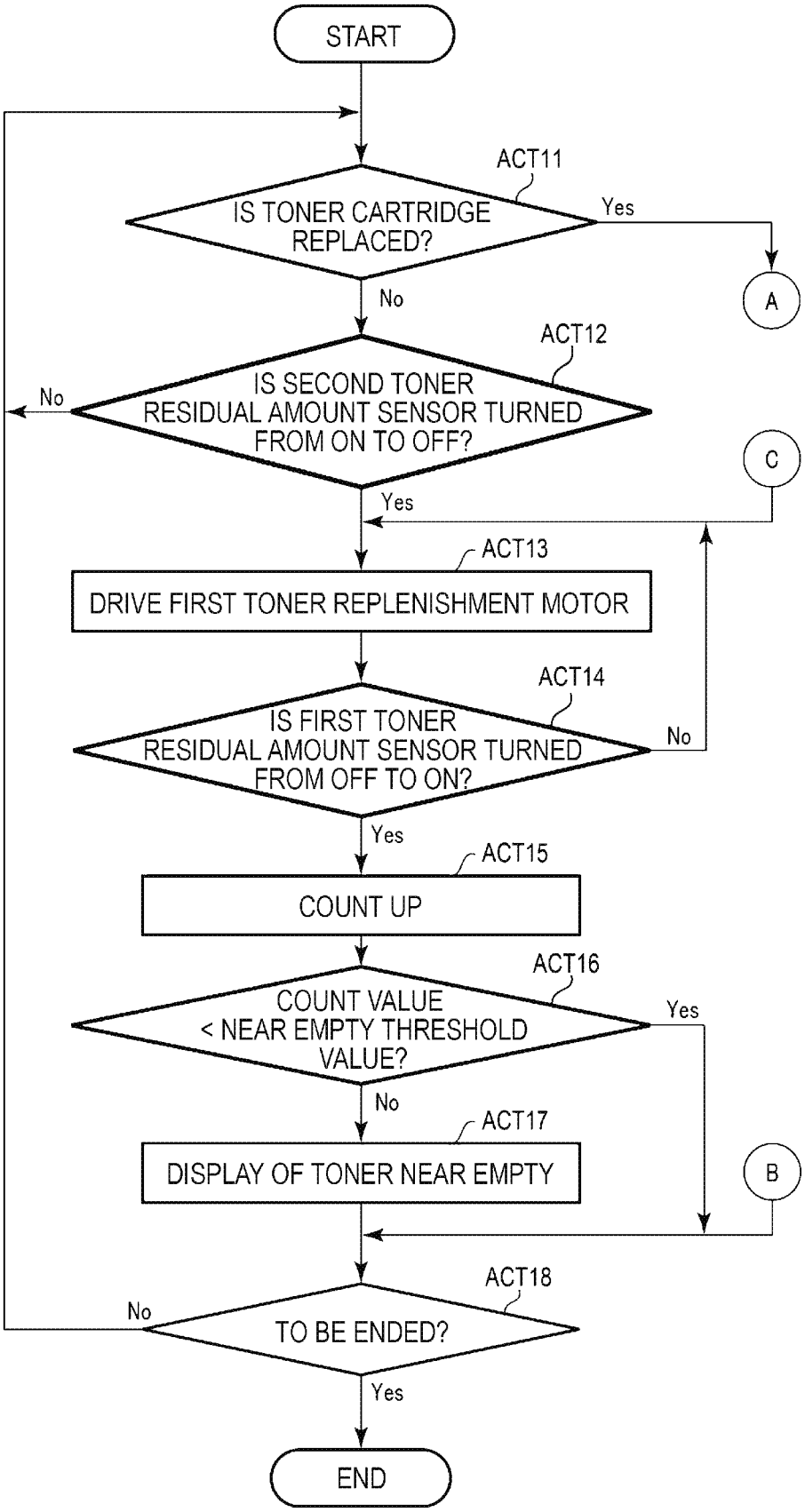
FIG. 3 is a flowchart of a process relating to a toner near empty display.
Figure 4:
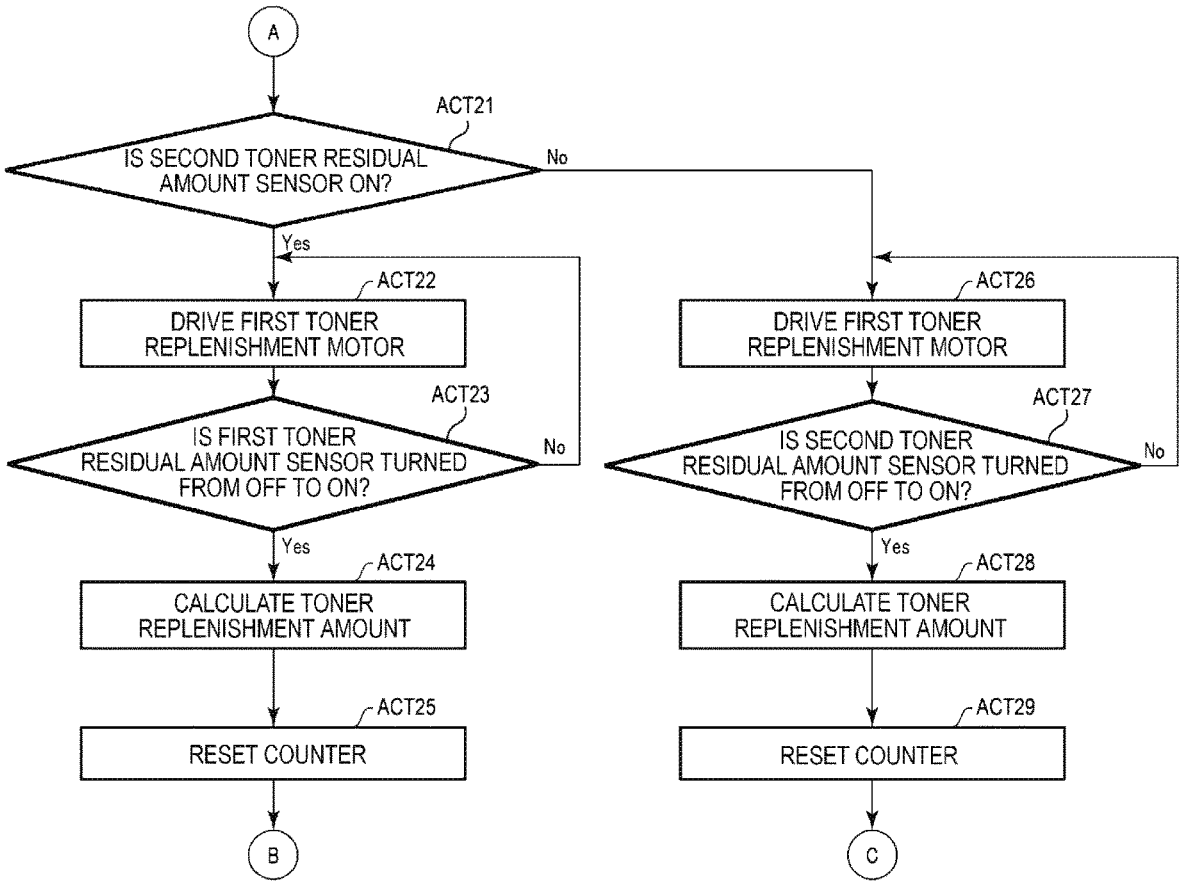
FIG. 4 is another flowchart of the process relating to the toner near empty display.

FIG. 3 and FIG. 4 are flowcharts for describing the process relating to the toner near empty display in the image forming apparatus 1. In this example, description will be made on the assumption that the processor 21 is configured to determine whether or not the residual amount of toner in the toner storage container 61 of the toner cartridge 2 is in the near empty state based on the number of times the first toner residual amount sensor 82 is turned from OFF to ON by operation of the first toner replenishment motor 51 and the second toner residual amount sensor 83 turned from ON to OFF and the near empty threshold value. In such a configuration, the processor sets a counter (storage area for storing a count value) for counting the number of times the first toner residual amount sensor 82 is turned from OFF to ON on the memory 22.

The processor 21 determines whether or not the toner cartridge 2 is replaced (ACT11). For example, the processor 21 communicates with the toner cartridge 2 through the toner cartridge communication interface 52 to determine whether or not the toner cartridge 2 is replaced. The processor 21 may be configured to determine whether or not the toner cartridge 2 is replaced, based on whether the front cover of the casing 11 is opened.

When it is determined that the toner cartridge is not replaced (NO in ACT11), the processor 21 determines whether or not the second toner residual amount sensor 83 is turned from ON to OFF (ACT12). When it is determined that the second toner residual amount sensor 83 is not is turned from ON to OFF (NO in ACT12), the process proceeds to ACT11. That is, the processor 21 repeatedly determines whether or not the toner cartridge is replaced and whether or not the second toner residual amount sensor 83 is turned from ON to OFF.

When it is determined that the second toner residual amount sensor 83 is turned from ON to OFF (YES in ACT12), the processor 21 drives the first toner replenishment motor 51 (ACT13). That is, the processor 21 causes the sub-tank 73 to be replenished with the toner from the toner cartridge 2. Furthermore, the processor 21 determines whether or not the first toner residual amount sensor 82 is turned from OFF to ON (ACT14). When it is determined that the first toner residual amount sensor 82 is not turned from OFF to ON (NO in ACT14), the process proceeds to ACT13. That is, the processor 21 continues replenishment of toner from the toner cartridge 2 to the sub-tank 73 until the first toner residual amount sensor 82 is turned from OFF to ON.

When it is determined that the first toner residual amount sensor 82 is turned from OFF to ON (YES in ACT14), the processor 21 stops the first toner replenishment motor 51, and counts up (for example, +1) a count value of the counter of the memory 22 (ACT15). As described above, the processor 21 may also be configured to count the number of times the second toner residual amount sensor 83 is turned from ON to OFF.

The processor 21 determines whether or not the count value of the counter is less than a near empty threshold value (ACT16).

When it is determined that the count value of the counter is equal to or greater than the near empty threshold value (NO in ACT16), the processor 21 performs display of a toner near empty (ACT17). That is, the processor 21 outputs, from the display unit 14 or the communication interface 12, toner near empty display indicating that the residual amount of toner in the toner cartridge 2 is low.

When it is determined that the count value of the counter is less than the near empty threshold value (YES in ACT16), the process proceeds to ACT18.

The processor 21 determines whether or not to end the process (ACT18). When it is determined that the process is not to be ended (NO in ACT18), the process proceeds to ACT11. When it is determined that that the process is to be ended (YES in ACT18), the processor 21 ends the process of FIG. 3.

When it is determined that the toner cartridge has been replaced in ACT11 described above (YES in ACT11), the process proceeds to ACT21 in FIG. 4. The processor 21 determines whether or the second toner residual amount sensor 83 is ON (ACT21).

When it is determined that the second toner residual amount sensor 83 is ON (YES in ACT21), the processor 21 drives the first toner replenishment motor 51 (ACT22). That is, the processor 21 causes the sub-tank 73 to be replenished with the toner from the toner cartridge 2. Furthermore, the processor 21 determines whether or not the first toner residual amount sensor 82 is turned from OFF to ON (ACT23). When it is determined that the first toner residual amount sensor 82 has not been turned from OFF to ON (NO in ACT23), the process proceeds to ACT22. That is, the processor 21 continues replenishment of toner from the toner cartridge 2 to the sub-tank 73 until the first toner residual amount sensor 82 is turned from OFF to ON.

When it is determined that the first toner residual amount sensor 82 has been turned from OFF to ON (YES in ACT23), the processor 21 stops the first toner replenishment motor 51 and calculates a toner replenishment amount (ACT24). For example, the processor 21 calculates the toner replenishment amount based on the drive time of the first toner replenishment motor 51 from the start of driving the first toner replenishment motor 51 until the first toner residual amount sensor 82 is turned from OFF to ON.

The processor 21 resets the count value of the counter of the memory 22 (ACT25), and the process proceeds to ACT18 of FIG. 3. The processor 21 may store the toner replenishment amount calculated in ACT24 in the memory 22, and determine whether or not to display toner near empty based on the count value, the toner replenishment amount, and the near empty threshold value in ACT16. The processor 21 may convert the toner replenishment amount calculated in ACT24 into a count value based on the toner replenishment amount per count, and add the converted count value to the counter after resetting the memory 22.

When it is determined that the second toner residual amount sensor 83 is not ON (NO in ACT21), the processor 21 drives the first toner replenishment motor 51 (ACT26). That is, the processor 21 causes the sub-tank 73 to be replenished with the toner from the toner cartridge 2. Furthermore, the processor 21 determines whether or not the second toner residual amount sensor 83 has been turned from OFF to ON (ACT27). When it is determined that the second toner residual amount sensor 83 has not been turned from OFF to ON (NO in ACT27), the process proceeds to ACT26. That is, the processor 21 continues replenishment of the toner from the toner cartridge 2 to the sub-tank 73 until the second toner residual amount sensor 83 is turned on from the off state.

When it is determined that the second toner residual amount sensor 83 is turned ON from the OFF state (YES in ACT27), the processor 21 stops the first toner replenishment motor 51 and calculates the toner replenishment amount (ACT28). For example, the processor 21 calculates the toner replenishment amount based on the drive time of the first toner replenishment motor 51 from the start of driving the first toner replenishment motor 51 until the second toner residual amount sensor 83 is turned from OFF to ON.

The processor 21 resets the count value of the counter of the memory 22 (ACT29), and the process proceeds to ACT13 of FIG. 3. The processor 21 may store the toner replenishment amount calculated in ACT28 in the memory 22 and determine whether or not to display the toner near empty based on the count value, the toner replenishment amount, and the near empty threshold value, in ACT16. Also, the processor 21 may convert the toner replenishment amount calculated in ACT28 into a count value based on an established or estimated toner replenishment amount per count, and add the converted count value to the counter after the memory 22 is reset.

As described above, the image forming apparatus 1 is configured such that the toner cartridge 2 can be replaced and includes the developing device 74 that causes the toner to be transferred to an electrostatic latent image on the photosensitive drum 71 to form a toner image, the sub-tank 73 that receives the toner from the toner cartridge 2 and supplies the toner to the developing device 74, the first toner residual amount sensor 82, the second toner residual amount sensor 83, and the processor 21. The first toner residual amount sensor 82 is turned ON when the amount of toner in the sub-tank 73 is equal to or more than a first toner residual amount. The second toner residual amount sensor 83 is turned ON when the amount of toner in the sub-tank 73 is equal to or more than a second toner residual amount which is smaller than the first toner residual amount. In such a configuration, the processor 21 outputs information on whether or not the toner cartridge 2 is short on the toner residual amount, based on either or both of the number of times the first toner residual amount sensor 82 is turned from ON to OFF or the number of times the second toner residual amount sensor 83 is turned from OFF to ON.

According to such a configuration, the processor 21 can calculate an actual volume of toner supplied from the toner cartridge 2 based on a known or estimated difference between the first toner residual amount and the second toner residual amount, and the number of times the first toner residual amount sensor 82 and the second toner residual amount sensor 83 are turned ON and OFF. With this configuration, the processor 21 can determine whether or not the toner cartridge 2 is short on the toner residual amount.

The image forming apparatus further includes the first toner replenishment motor 51 that supplies the toner from the toner cartridge 2 to the sub-tank 73. The processor 21 causes the toner replenishment motor 31 to supply the toner from the sub-tank 73 to the developing device 74 when the second toner residual amount sensor 83 is turned from ON to OFF. Furthermore, the processor 21 outputs information on whether the toner cartridge 2 is short on the toner residual amount, based on the number of times the first toner residual amount sensor 82 is turned from OFF to ON.

The processor 21 causes the first toner replenishment motor 51 to supply the toner from the sub-tank 73 to the developing device 74 when the toner cartridge 2 is replaced and the second toner residual amount sensor 83 is ON. Furthermore, the processor 21 may output information on whether the toner cartridge 2 is short on the toner residual amount, based on the drive amount of the first toner replenishment motor 51 from when the first toner residual amount sensor 82 is turned OFF to when it is turned ON, and the number of times the first toner residual amount sensor 82 is turned from OFF to ON. According to this configuration, the processor 21 can calculate a difference between the residual amount of toner in the sub-tank 73 and the first residual amount of toner based on the drive amount of the first toner replenishment motor 51 and can add the difference to the determination as to whether or not the toner cartridge 2 is short on the toner residual amount.

The processor 21 causes the first toner replenishment motor 51 to supply the toner from the sub-tank 73 to the developing device 74 when the toner cartridge 2 is replaced and the second toner residual amount sensor 83 is OFF. Furthermore, the processor 21 may output information, based on the drive amount of the first toner replenishment motor 51 from when the second toner residual amount sensor 83 is turned OFF to when it is turned ON, and the number of times the first toner residual amount sensor 82 is turned from OFF to ON, on whether the toner cartridge 2 is short on the toner residual amount. According to this configuration, the processor 21 can calculate a difference between the residual amount of toner in the sub-tank 73 and the second residual amount of toner based on the drive amount of the first toner replenishment motor 51 and can add the difference to the determination as to whether or not the toner cartridge 2 is short on the toner residual amount.

The processor 21 causes the first toner replenishment motor 51 to supply the toner from the sub-tank 73 to the developing device 74 when the second toner residual amount sensor 83 is turned from ON to OFF. Furthermore, the processor 21 may output information on whether the toner cartridge 2 is short on the toner residual amount, based on the number of times the second toner residual amount sensor 83 is turned from ON to OFF.

The processor 21 causes the first toner replenishment motor 51 to supply the toner from the sub-tank 73 to the developing device 74 when the toner cartridge 2 is replaced and the second toner residual amount sensor 83 is ON. Furthermore, the processor 21 may be configured to output whether the toner cartridge 2 is short on the toner residual amount, based on the drive amount of the first toner replenishment motor 51 from when the first toner residual amount sensor **8*e* is turned OFF to when it is turned ON, and the number of times the second toner residual amount sensor 823 is turned from ON to OFF. According to this configuration, the processor 21 can calculate a difference between the residual amount of toner in the sub-tank 73 and the first residual amount of toner based on the drive amount of the first toner replenishment motor 51 and can add the difference to the determination as to whether or not the toner cartridge 2** is short on the toner residual amount.

The processor 21 causes the first toner replenishment motor 51 to supply the toner from the sub-tank 73 to the developing device 74 when the toner cartridge 2 is replaced and the second toner residual amount sensor 83 is OFF. Furthermore, the processor 21 may be configured to output information on whether the toner cartridge 2 is short on the toner residual amount, based on the drive amount of the first toner replenishment motor 51 from when the second toner residual amount sensor 83 is turned OFF to when it is turned ON, and the number of times the second toner residual amount sensor 83 is turned from ON to OFF. According to this configuration, the processor 21 can calculate a difference between the residual amount of toner in the sub-tank 73 and the second residual amount of toner based on the drive amount of the first toner replenishment motor 51 and can add the difference to the determination as to whether or not the toner cartridge 2 is short on the toner residual amount.

In the embodiment described above, a configuration in which the processor 21 outputs information on whether or not the toner cartridge 2 is short on the toner residual amount, based on the number of times the first toner residual amount sensor 82 and the second toner residual amount sensor 83 are turned ON and OFF is described, but is not limited to the configuration. The processor 21 may be configured to calculate weight or volume discharged from the toner cartridge 2, or a ratio to an initial amount of toner in the toner cartridge 2 and compare the weight, the volume, or the ratio with the near empty threshold value, based on the number of times the first toner residual amount sensor 82 and the second toner residual amount sensor 83 are turned ON and OFF.

The functions described in each embodiment described above is not limited to a configuration using only hardware, and can also be realized by causing a computer to read a software program in which each function is implemented algorithmically. Each function may be implemented by selecting either software or hardware as appropriate.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a developing device configured to supply toner to a photosensitive drum;

a toner tank configured to receive toner supplied from a toner cartridge mounted in the image forming apparatus and supply toner to the developing device;

a first toner sensor configured to detect a first toner residual level in the toner tank;

a second toner sensor configured to detect a second toner residual level lower than the first toner residual level in the toner tank; and a processor configured to:

count a number of times the first toner sensor switches from a non-detection state to a detection state subsequent to the second toner sensor switching from a detection state to a non-detection state; and output a notification signal to indicate a residual amount of toner in the toner cartridge based on the counted number.

2. The image forming apparatus according to claim 1, wherein the processor is further configured to compare the counted number and a threshold value.

3. The image forming apparatus according to claim 2, wherein the processor is configured to receive the threshold value from the toner cartridge.

4. The image forming apparatus according to claim 1, further comprising:

a toner supply motor configured to cause toner to be supplied from the toner cartridge to the toner tank, wherein the processor is further configured to control the toner supply motor to cause toner to be supplied from the toner cartridge to the toner tank upon the second toner sensor transitioning from the detection state to the non-detection state until the first toner sensor transitions from the non-detection state to the detection state.

5. The image forming apparatus according to claim 1, wherein the processor is further configured to reset the counted number upon detecting a toner cartridge replacement based on communication with a replacement toner cartridge.

6. The image forming apparatus according to claim 5, further comprising:

a toner supply motor configured to cause toner to be supplied from the toner cartridge to the toner tank, wherein when the second toner sensor is in the detection state upon detection of the toner cartridge replacement, the processor is configured to control the toner supply motor to cause toner to be supplied from the replacement toner cartridge to the toner tank during a first time period until the first toner sensor transitions from the non-detection state to the detection state and calculates a first amount of toner supplied during the first time period, and when the second toner sensor is in the non-detection state upon detection of the toner cartridge replacement, the processor controls the toner supply motor to cause toner to be supplied from the replacement toner cartridge to the toner tank during a second time period until the second toner sensor transitions from the non-detection state to the detection state and calculates a second amount of toner supplied during the second time period.

7. The image forming apparatus according to claim 6, wherein the processor is configured to output the notification signal based on at least one of the first amount and the second amount.

8. The image forming apparatus according to claim 1, further comprising:

a display device, wherein the notification signal causes the display device to display a message indicating the residual amount of toner in the toner cartridge.

9. An image forming apparatus, comprising:

a developing device configured to supply toner to a photosensitive drum;

a toner tank configured to receive toner supplied from a toner cartridge mounted in the image forming apparatus and supply toner to the developing device;

a first toner sensor configured to detect a first toner residual level in the toner tank;

a second toner sensor configured to detect a second toner residual level lower than the first toner residual level in the toner tank;

a toner supply motor configured to cause toner to be supplied from the toner cartridge to the toner tank; and a processor configured to:

control the toner supply motor to cause toner to be supplied from the toner cartridge to the toner tank until the first toner sensor switches from the non-detection state to the detection state if the second toner sensor switches from the detection state to the non-detection state;

count a number of times the second toner sensor switches from a non-detection state to a detection state; and output a notification signal indicating a residual amount of toner in the toner cartridge based on the counted number.

10. The image forming apparatus according to claim 9, wherein the processor is further configured to compare the counted number and a threshold value.

11. The image forming apparatus according to claim 10, wherein the processor is configured to receive the threshold value from the toner cartridge.

12. The image forming apparatus according to claim 10, wherein the processor is further configured to detect a toner cartridge replacement based on communication with a replacement toner cartridge, and reset the counted number upon detecting the toner cartridge replacement.

13. The image forming apparatus according to claim 12, wherein when the second toner sensor is in the detection state upon detection of the toner cartridge replacement, the processor is configured to control the toner supply motor to cause toner to be supplied from the replacement toner cartridge to the toner tank during a first time period until the first toner sensor transitions from the non-detection state to the detection state and calculates a first amount of toner supplied during the first time period, and when the second toner sensor is in the non-detection state upon detection of the toner cartridge replacement, the processor controls the toner supply motor to cause toner to be supplied from the replacement toner cartridge to the toner tank during a second time period until the second toner sensor transitions from the non-detection state to the detection state and calculates a second amount of toner supplied during the second time period.

14. The image forming apparatus according to claim 13, wherein the processor is configured to output the notification signal based on at least one of the first amount and the second amount.

15. The image forming apparatus according to claim 9, further comprising:

a display device, wherein the notification signal causes the display device to display a message indicating the residual amount of toner in the toner cartridge.

16. A method for controlling an image forming apparatus comprising a developing device configured to supply toner to a photosensitive drum;

a toner tank configured to receive toner supplied from a toner cartridge mounted in the image forming apparatus and supply toner to the developing device;

a first toner sensor configured to detect a first toner residual level in the toner tank; and a second toner sensor configured to detect a second toner residual level lower than the first toner residual level in the toner tank, the method comprising:

counting a number of times the first toner sensor switches from a non-detection state to a detection state subsequent to the second toner sensor switching from a detection state to a non-detection state; and outputting a notification signal indicating a residual amount of toner in the toner cartridge based on the counted number.

17. The method according to claim 16, further comprising:

comparing the counted number and a threshold value.

18. The method according to claim 17, further comprising:

receiving the threshold value from the toner cartridge.

19. The method according to claim 16, the method further comprising:

controlling a toner supply motor to cause toner to be supplied from the toner cartridge to the toner tank upon the second toner sensor transitioning from the detection state to the non-detection state until the first toner sensor transitions from the non-detection state to the detection state.

20. The method according to claim 16, further comprising:

detecting a toner cartridge replacement based on communication with a replacement toner cartridge; and resetting the counted number upon detecting the toner cartridge replacement.

* * * * *